US006905228B1

(12) United States Patent
Takeyasu et al.

(10) Patent No.: US 6,905,228 B1
(45) Date of Patent: Jun. 14, 2005

(54) LED LIGHTING FIXTURE

(75) Inventors: Mitsuru Takeyasu, Ikeda (JP); Tadahiro Arimura, Ikeda (JP); Yoshihisa Tabata, Ikeda (JP); Daisuke Kaibara, Ikeda (JP)

(73) Assignee: Zeni Lite Buoy Co., Ltd., Osaka (JP)

( * ) Notice: Subject to any disclaimer, the term of this patent is extended or adjusted under 35 U.S.C. 154(b) by 497 days.

(21) Appl. No.: 09/706,408

(22) Filed: Nov. 3, 2000

(30) Foreign Application Priority Data

Nov. 5, 1999 (JP) ..... 11-315519

(51) Int. Cl.[7] ..... F21V 21/00

(52) U.S. Cl. ..... 362/249; 362/244; 362/545; 362/800; 257/98; 257/432

(58) Field of Search ..... 362/235, 237, 362/240, 244, 249, 268, 217, 309, 310, 335, 362/355, 456, 545, 800; 257/98, 432

(56) References Cited

U.S. PATENT DOCUMENTS

| | | | | |
|---|---|---|---|---|
| 5,844,257 | A * | 12/1998 | Chen | 257/91 |
| 5,894,196 | A * | 4/1999 | McDermott | 313/512 |
| 5,898,267 | A * | 4/1999 | McDermott | 313/512 |
| 5,899,557 | A * | 5/1999 | McDermott | 362/244 |
| 5,924,788 | A * | 7/1999 | Parkyn, Jr. | 362/329 |
| 6,048,083 | A * | 4/2000 | McDermott | 362/244 |
| 6,086,220 | A * | 7/2000 | Lash et al. | 362/244 |
| 6,244,727 | B1 * | 6/2001 | Ryan et al. | 362/237 |
| 6,483,439 | B1 * | 11/2002 | Vukosic | 340/815.65 |

* cited by examiner

*Primary Examiner*—John Anthony Ward
(74) *Attorney, Agent, or Firm*—Koda & Androlia

(57) ABSTRACT

In the centers of each of unit-type lenses that constitute a lens, a plurality of elliptically light distributing LEDs being arranged circularly in a horizontal direction in such a way that a wider divergence angle of each LED is set to be oriented horizontally. The unit-type lenses are stacked and fastened by a screw that runs through the bosses of the unit-type lenses.

7 Claims, 6 Drawing Sheets

LED LIGHTING FIXTURE

BACKGROUND OF THE INVENTION

1. Field of the Invention

The present invention relates to a lighting fixture used as a navigational aid, using light-emitting diodes (LEDs) having different divergence angles in the horizontal and perpendicular directions, i.e., a so-called elliptic light distribution, as the light source.

2. Prior Art

LEDs are widely used as light sources in navigational aids on account of their low power consumption and low failure rate.

Because the light-emitting energy of a single LED is small, a tubular lens is typically used to surround several LEDs in order to concentrate their light by convergence, thereby increasing their effective illumination. However, if LEDs with a high convergence rate are arranged in a large array, their light is not distributed uniformly in the horizontal circumferential direction, which is how the light should ideally be distributed. Therefore, in order to distribute the light horizontally and uniformly, LEDs with a wider divergence angle have been used conventionally.

Typically the divergence angle is 30° or so for both the horizontal divergence angle and the perpendicular divergence angle. To make the horizontal light distribution more nearly concentric, a multitude of LEDs need to be arranged horizontally. In some cases, as many as 80 LEDs are arranged in a row.

Since typical lighting fixtures for navigational aid purposes use several tiers of LEDs, the total number of LEDs used in a lighting fixture can be very large.

As the number of LEDs per tier increases, the outer diameter of the substrate on which the LEDs are mounted also needs to be increased, with the result that the outer diameter of the lighting fixture has to be made larger.

SUMMARY OF THE INVENTION

The object of the present invention is to provide an LED lighting fixture that makes the horizontal light distribution nearly concentric using as few LEDs as possible, thereby realizing uniform and horizontal light distribution.

Another object of the present invention is to provide an LED lighting fixture in which the size and weight of the lighting fixture is as small as possible by minimizing the number of LEDs required.

When arranging several tiers of LEDs and surrounding them with a tubular lens so that the light from the LEDs converges, different sizes of lenses are necessary depending on how many tiers of LEDs are used. As a result, several kinds of lenses need to be prepared. The present invention solves this problem by allowing the same kind of lens to be placed one on the other in several tiers according to the number of tiers of LEDs.

However, using a lens or lenses is itself a cost factor. Firstly, a process is required to make a lens or lenses. Secondly, because LEDs need to be arranged at the focal point of the lens, increasing the number of LEDs per tier necessitates that the diameter of the lens be increased. This means that for each distinctive quantity of LEDs, a different size of lens is necessary.

The present invention solves this problem by employing newly developed LEDs with an extremely wide horizontal divergence angle so that it is possible to make a lighting fixture for navigational aid without using a lens or lenses.

So as to achieve the first object of the present invention, the present invention arranges several elliptically light distributing LEDs radially (i.e., in a spoke-like manner) around a horizontal circumference in such a way that the wider divergence angle of each LED is horizontally oriented; and around the radially arranged elliptically light distributing LEDs, a lens that converges the light from the LEDs in the horizontal circumferential direction is provided.

By way the arrangement of the LEDs and lens as described above, it is possible to make the horizontal light distribution of the LEDs nearly concentric and uniform while using a small number of LEDs.

BRIEF DESCRIPTION OF THE DRAWINGS

FIG. 4(*b*) illustrates the light distribution characteristics of elliptically light distributing LEDs having a horizontal divergence angle of 70° and a perpendicular divergence angle of 30° according to the present invention;

FIG. 4(*c*) illustrates the light distribution characteristics of the same LEDs as in FIG. 4(*b*) with an exception that in FIG. 4(*c*) the inner surface of the lens is equipped with a diffusion part that diffuses light only in the horizontal direction;

DETAILED DESCRIPTION OF THE PREFERRED EMBODIMENTS

The principle of the present invention will be explained first with reference to FIGS. 4(*a*) through 4(*c*).

Figure 4C:
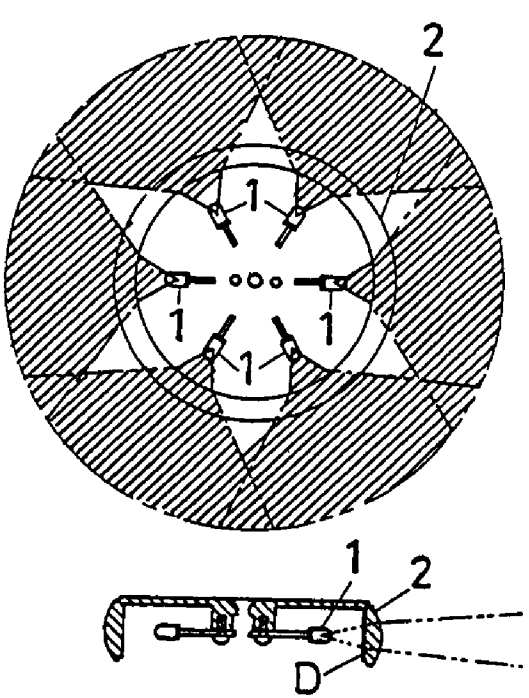
FIG. 4(*a*) illustrates the light distribution characteristics of conventional LEDs having a divergence angle of 30° for both the horizontal and perpendicular directions and being radially arranged around the horizontal circumference in the unit-type lens used in the present invention.
Figure 4B:
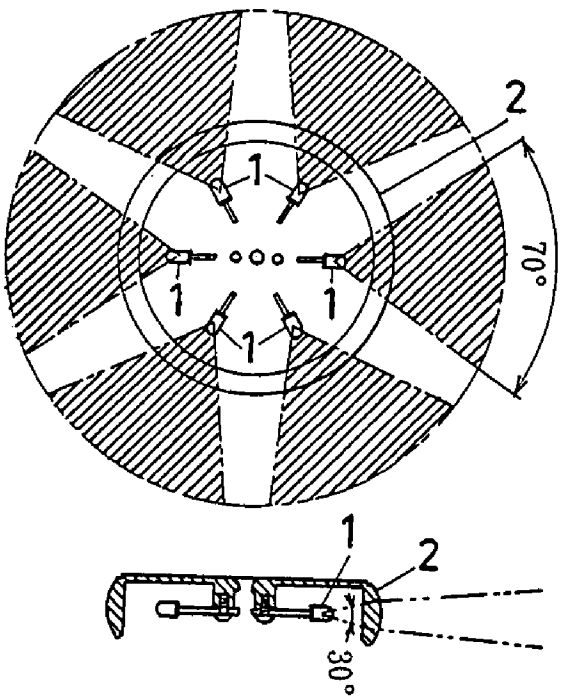
Figure 4A:
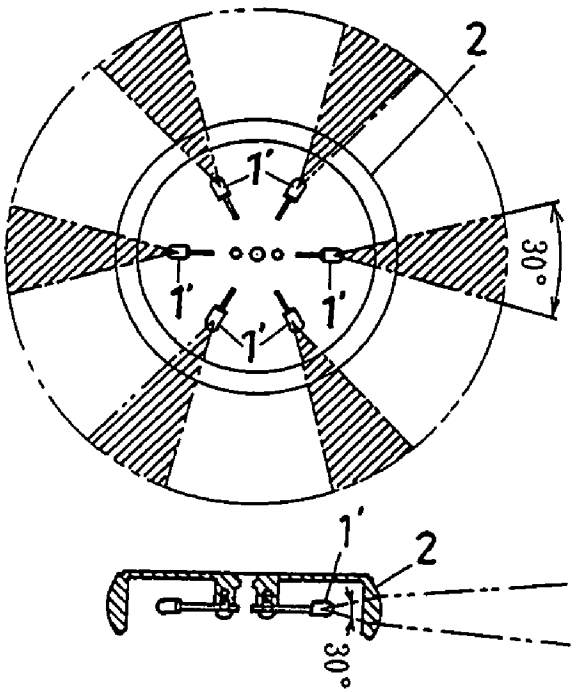

FIG. 4(*a*) shows the light distribution characteristics of conventional LEDs having a divergence angle of 30° in both the horizontal and perpendicular directions. FIG. 4(*b*) shows light distribution characteristics of elliptically light distributing LEDs having a horizontal divergence angle of 70° and a perpendicular divergence angle of 30°, so that the LEDs are arranged so that the wider divergence angle of each LED is horizontally oriented. Comparing these two, it can be recognized that the radiation range is larger in the case of FIG. 4(*b*) than in the case of FIG. 4(*a*) even though the same number (six) of LEDs are used.

When several LEDs are arranged radially around a horizontal circumference or arranged circularly on a horizontal plane, and a lens 2 converging the light from the LEDs in the horizontal circumferential direction is provided around the LEDs, a higher horizontal light distribution performance is obtained as seen from FIG. 4(*b*) when elliptically light distributing LEDs 1 are arranged so that the wider divergence angle of each LED 1 is horizontally oriented compared with when conventional LEDs having the same divergence angle, 30°, for both the horizontal and perpendicular directions, are used.

In other words, by using elliptically light distributing LEDs, it is possible to reduce the number of LEDs that are arranged horizontally. It is also possible to make the lighting fixture lighter and smaller.

As seen from FIG. 4(*c*), it is preferable to provide the inner surface of the lens 2 with a diffusion part D that diffuses light only in the horizontal direction. With the inner surface of the lens 2 that has the diffusion part D, even if the light distribution characteristics of the LEDs 1 are such that some areas remain unlit, as indicated by the white areas in FIG. 4(*b*), the light that passes through the diffusion part D is diffused, and as a result an ideal light-distribution condition as shown in FIG. 4(*c*) in which solid white areas are much smaller is obtained. In this way, it is possible to horizontally distribute light more uniformly.

From the opposite viewpoint, the diffusion part D on the inner surface of the lens 2 can accomplish horizontally uniform light distribution with a smaller number of elliptically light distributing LEDs 1. Even in a situation in which white areas appear because the number of elliptically light distributing LEDs 1 arranged inside the lens 2 is small as shown in FIG. 4(*b*), it is still possible to horizontally distribute light uniformly as shown in FIG. 4(*c*). As a result, the ultimate goal of the present invention is accomplished which is to make the number of LEDs 1 as small as possible.

Figure 5A:
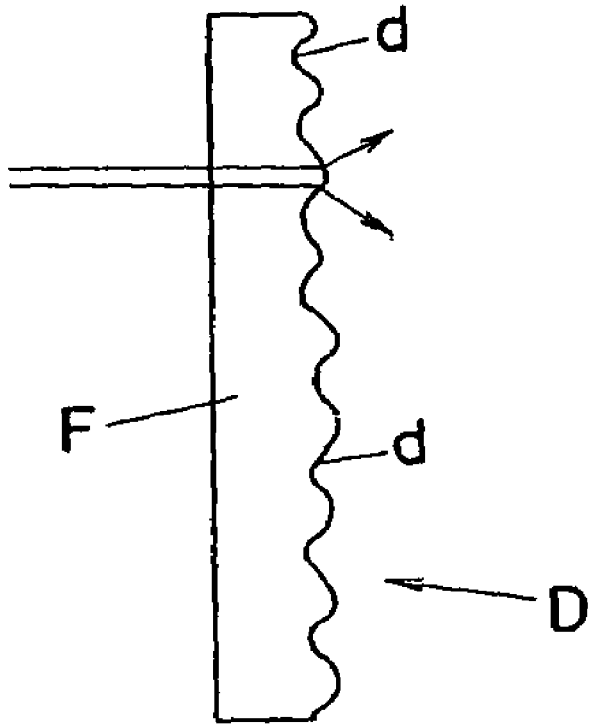
FIGS. 5(*a*) and 5(*b*) show the function of the diffuser.
Figure 5B:
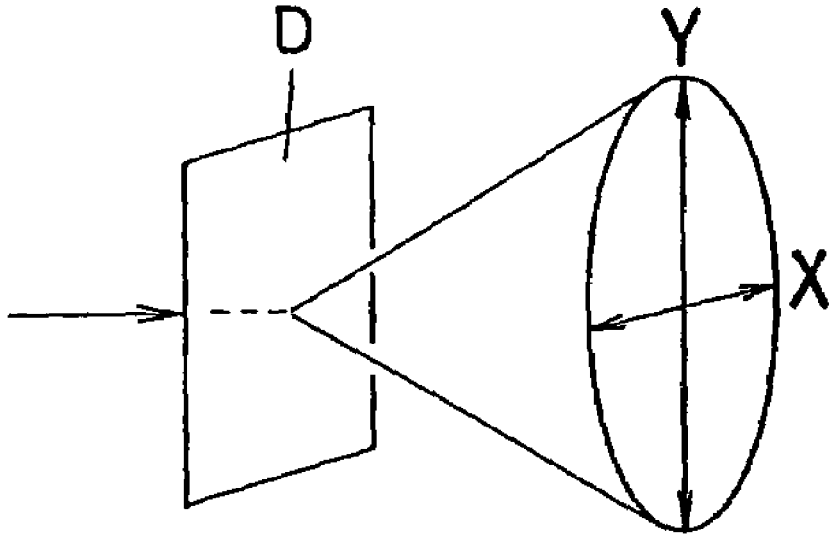

The diffusion part D is preferably made of a film F (see FIG. 5(*a*)). It is possible to make the lens 2 of synthetic resin and to integrally mould the diffusion part D onto its inner surface; however, it is easier and more cost effective to use a film F as the diffusion part D and to paste it on the inner surface of the lens 2.

Figure 1:
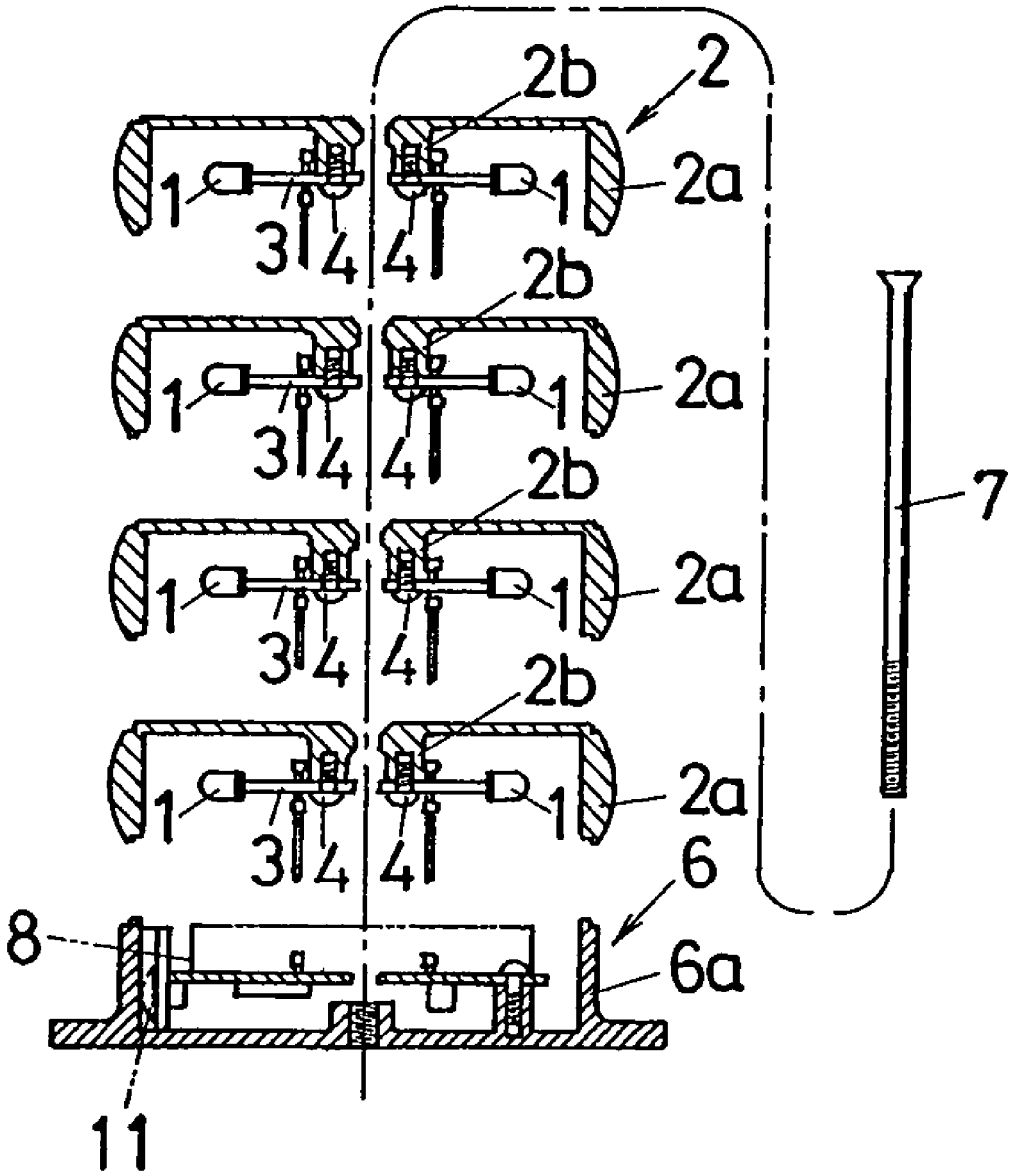
FIG. 1 is a cross sectional view of an example of a lens unit comprising several tiers of unit-type tubular lenses according to the present invention, wherein in the center of each unit-type lens, elliptically light distributing LEDs are radially arranged around the horizontal circumference; and in this view, each one of the unit-type lenses is separated from other unit-type lens.
Figure 2:
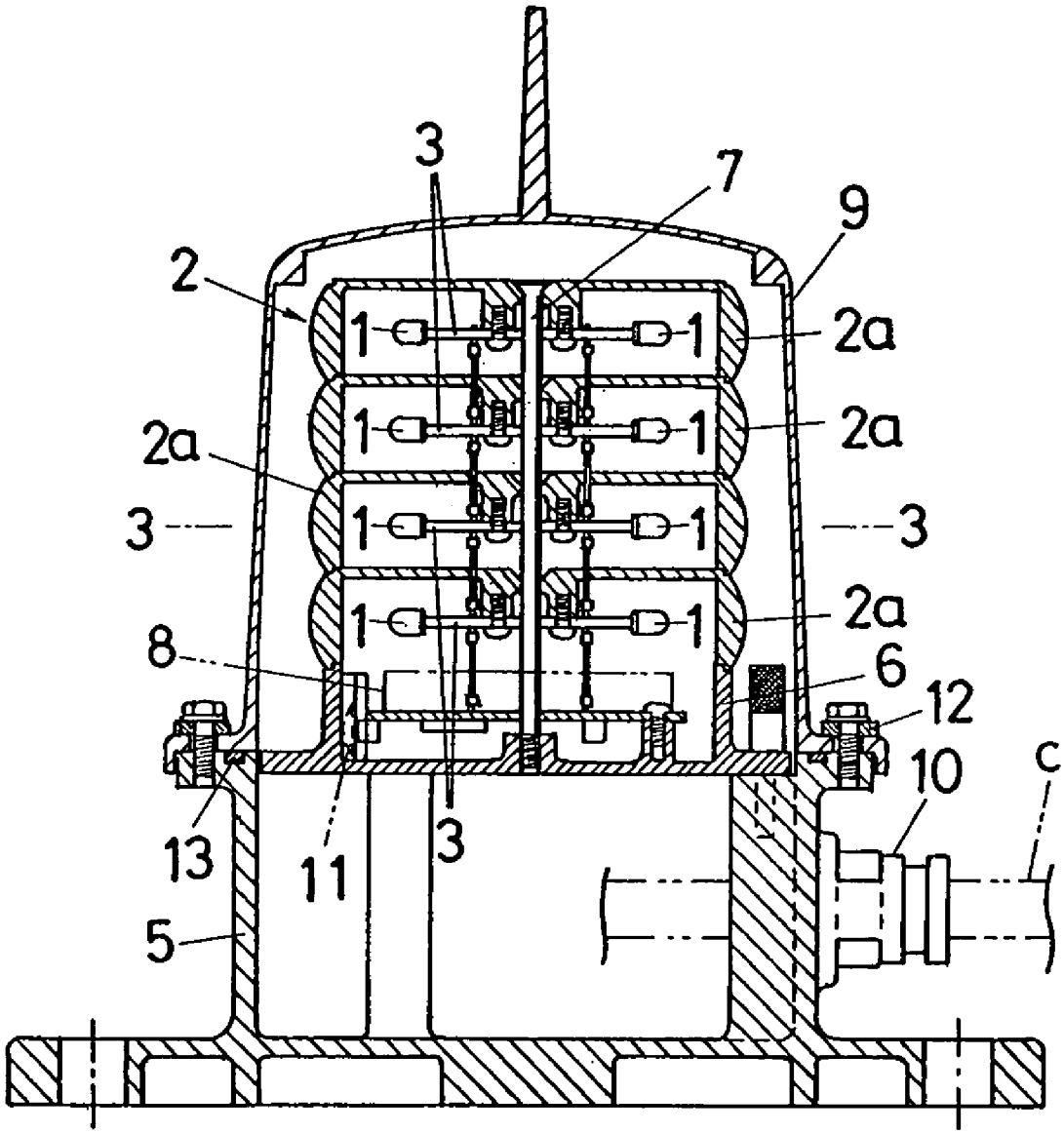
FIG. 2 is a cross sectional view of the lighting fixture according to the present invention in which four tiers of unit-type tubular lenses are installed on the base of the lighting fixture.

It is also preferable to form the lens 2 with several unit-type lenses 2*a* (see FIGS. 1 and 2). In the center of each of these lenses 2*a*, several elliptically light distributing LEDs 1 are installed in a horizontal circumference direction.

With this configuration, it is possible to arrange the several LEDs 1 easily and accurately on a horizontal circumference inside each lens, and it is also possible to easily make a lens unit in which the LEDs and the lenses are integrated.

Because the lenses 2*a* are of a unit type, they can be stacked or placed one on the other easily. An LED lighting fixture made of two or more tiers of unit-type lenses 2*a* can be easily assembled by simply stacking two or more of these unit-type lenses 2*a*.

By increasing or decreasing the number of unit-type lenses 2*a*, the number of tiers can be easily changed. Moreover, even if the number of tiers is changed, there is no need to prepare a special lens to accommodate the different height of the lighting fixture. Instead, only the number of identical unit-type lenses needs to be changed.

A screw 7 is preferably used so that it runs through the bosses (hubs) 2*b* of the stacked unit-type lenses 2*a* so as to fasten the unit-type lenses 2*a*.

With this arrangement, several unit-type lenses 2*a* can be stacked quite easily.

On the other hand, by using elliptically light distributing LEDs that have a horizontal divergence angle of 120°–150°, which is wider than that of a conventional LED, and a perpendicular divergence angle that is narrower than that of a conventional LED, it is possible to make an effective navigational aid without using lenses at all.

By using such LEDs with an extremely wide horizontal divergence angle and a much narrower perpendicular divergence angle than those of conventional LEDs, lenses and the process of forming lenses become unnecessary. This lowers costs and enables a wide variety of arrangements of the elliptically light distributing LEDs because there is no need to take into consideration the positions of the focal points of the lenses. Furthermore, the number of LEDs per tier can be increased without being restricted by the lens diameter.

Preferred embodiments and more detailed description of the present invention will now be described with reference to the accompanying drawings.

In the present invention, instead of conventional LEDs having a divergence angle of 30° for both the horizontal direction and perpendicular direction (indicated by 1' in FIG. 4(*a*)), elliptically light distributing LEDs (indicated by the reference numeral 1 in FIG. 4(*b*)) that have an elliptic light distribution, at least in the horizontal direction, with a horizontal divergence angle of 70° and a perpendicular divergence angle of 30° are used. Several LEDs 1 are arranged radially around the horizontal circumference or arranged circularly on a horizontal plane so that the wider divergence angle is oriented horizontally, in this embodiment, so that the horizontal divergence angle is 70°. FIG. 4(*a*) shows an example that uses LEDs 1' having the same divergence angle in the horizontal and perpendicular directions, FIGS. 4(*b*) and 4(*c*) show examples that use the elliptically light distributing LEDs 1 as employed in the present invention.

The difference in the light-distribution characteristics of these examples will be described.

In FIGS. 4(*a*) through 4(*c*), horizontal light distribution characteristics are shown above the perpendicular light distribution characteristics.

When FIGS. 4(*a*) and 4(*b*) are compared, it can be seen that while the same number of LEDs are arranged in the circumferential direction in each case, the illumination range is larger in the case of FIG. 4(*b*) than in the case of FIG. 4(*a*). This means that the elliptically light distributing LEDs 1 (according to the present invention) have a substantially improved light distribution performance than conventional LEDs 1' having the same divergence angle in the horizontal and perpendicular directions. The principle of this concept is as explained before. In other words, by using elliptically light distributing LEDs, the number of LEDs arranged horizontally can be reduced. As a result, it is also possible to make the lighting fixture lighter and smaller.

As seen from FIG. 4(*c*), it is preferable to provide the inner surface of the tubular lens 2 with a diffusion part D that diffuses light only in the horizontal direction. With the inner surface of the tubular lens 2 that has the diffusion part D, even if the light distribution characteristics of the LEDs 1 are such that some areas remain unlit, as indicated by the white areas in FIG. 4(*b*), the light that passes through the diffusion part D is diffused, an ideal light-distribution condition as shown in FIG. 4(*c*) in which white areas are much smaller is provided. In this way, it is possible to horizontally distribute light more uniformly.

In other words, with the diffusion part D provided on the inner surface of the lens 2, it is possible to achieve horizontally uniform light distribution with a small number of elliptically light distributing LEDs 1.

The diffusion part D functions as a diffuser. The diffusion angle of the transmitted light, or more specifically, the X-axis (horizontal) diffusion angle and the Y-axis (perpendicular) diffusion angle shown in FIG. 5(*b*), can be controlled by adjusting the average height and average pitch of the ridges of the finely waved surface d shown in FIG. 5(*a*).

According to the present invention, the diffusion part D can only diffuse light in the X-axis (horizontal) direction; as a result, the diffusion part D or the diffuser achieves uniform light distribution in the horizontal direction.

The diffusion part D is preferably a film F. Although it is possible to form the tubular lens 2 with a synthetic resin and to integrally mould the diffusion part D on its inner surface, it is easier and more cost effective to make the diffusion part D as a film F and paste it on the inner surface of the tubular lens 2.

Figure 3:
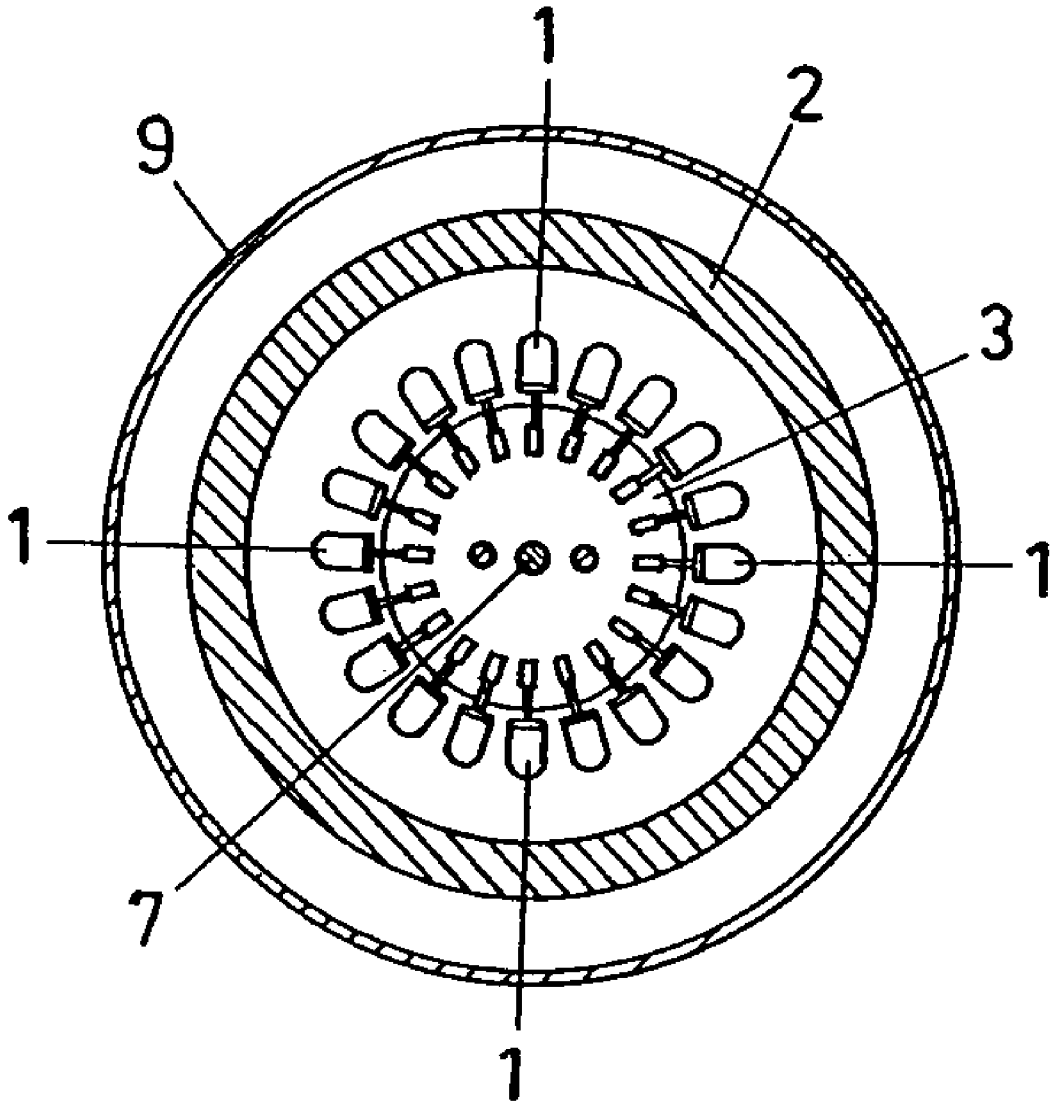
FIG. 3 is a cross sectional view taken along the line 3—3 in FIG. 2.

In order to arrange the elliptically light distributing LEDs 1 radially around the horizontal circumference, the tubular lens 2 to be located outside the LEDs is comprised of several unit-type lenses 2*a*; and inside and at the center of each of these lenses 2*a*, a plurality of elliptically light distributing LEDs 1 are installed radially around the horizontal circumference or installed circularly on a horizontal plane (see FIG. 3). These elliptically light distributing LEDs 1 are installed directly at the center of each of the unit-type lenses 2*a*. Instead, they can be mounted radially on a single circuit board 3, and this circuit board 3 in turn is secured to the boss 2*b* which is at the center of each unit-type lens 2*a* via screws 4.

According to this configuration, the LEDs 1 are arranged around the horizontal circumference inside the tubular lens 2 easily, accurately, uniformly and radially. Moreover, a lens unit in which the LEDs 1 and the lens 2 are integrated as shown in FIG. 1 can be made easily.

Because the lenses 2*a* are of a unit type, they can be stacked easily. An LED lighting fixture made of two or more tiers of unit-type LEDs can be easily obtained by simply stacking two or more of these unit-type lenses 2*a*. FIG. 2 shows an example of a lighting fixture in which four tiers of unit-type lenses 2*a* are stacked.

By increasing or decreasing the number of unit-type lenses 2*a* to be stacked, the number of tiers can be easily changed. Moreover, though the number of tiers is changed, there is no need to prepare a special lens to accommodate a different height of lighting fixture. Instead, only the number of identical unit-type lenses needs to be changed.

So as to prevent the unit-type lenses 2*a* from moving unnecessarily when they are placed one on the other, each of the unit-type lens 2*a* in this embodiment is provided with a protrusion (not shown) and an indentation (not shown) at the outer edge of either the upper end face or lower end face. Thus, when the lenses 2*a* are stacked, the protrusion of one lens engages with the indentation of another.

As shown in FIGS. 1 and 2, the unit-type lenses 2*a* are mounted on the outer casing 6*a* of a flasher case 6 mounted inside the base 5 of the lighting fixture, so that the unit-type lens 2*a* at the bottom does not move unnecessarily with respect to the outer casing 6*a* of the flasher case 6.

A screw 7 is used so that it runs through the bosses (hubs) 2*b* of the stacked unit-type lenses 2*a* so as to fasten the unit-type lenses 2*a*.

With this arrangement, in which the screw 7 is provided so as to run through and screws into a portion of the lighting fixture (the center of the flasher case 6 in this example), several unit-type lenses 2*a* are stacked quite easily and securely.

The circuit boards 3 in the centers of the stacked unit-type lenses 2*a* are all connected electrically with each other and to the flasher unit 8 inside the flasher case 6 as shown in FIG. 2. The several elliptically light distributing LEDs 1 mounted on the circuit boards 3 are also connected electrically and emit light in the direction of the perimeter.

In FIG. 2, the reference numeral 9 is a cover placed outside the stacked unit-type lenses 2*a*. The bottom of the cover 9 is fastened to the base 5 circumferentially.

The reference numeral 10 is a plug for holding a lead wire c in place at the point where it enters the base 5. The lead wire c is connected to the flasher unit 8. The reference numeral 11 is a photo sensor, 12 is a ring plate and 13 is an O-ring.

The above embodiment is an example of the present invention that uses a lens. The present invention can be applied to a navigational aid that uses no lens. In the navigational aid that uses no lens, elliptically light distributing LEDs having a horizontal divergence angle of 120°–150°, which is wider than that of a conventional LED, and a perpendicular divergence angle that is narrower than that of a conventional LED, are used.

Figure 6A:
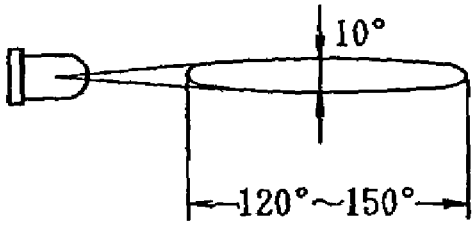
FIGS. 6(*a*) and 6(*b*) are schematic illustrations for contrasting two types of elliptic light distribution patterns produced by different elliptically light distributing LEDs, in which FIG. 6(*a*) is an example of the present invention, and FIG. 6(*b*) is that of a conventional, commercially available LED.
Figure 6B:
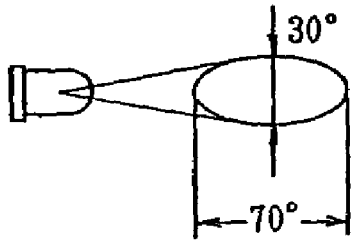
FIG. 6(b) PRIOR ART

FIG. 6(*a*) shows the elliptic light distribution of an LED having a horizontal divergence angle of 120°–150° and a perpendicular divergence angle of 10°.

FIG. 6(*b*), on the other hand, shows the elliptic light distribution of a conventional, commercially available, elliptically light distributing LED. The horizontal divergence angle and perpendicular divergence angle of this LED are 70° and 30°, respectively.

By using such LEDs that have an extremely wide horizontal divergence angle and a much narrower perpendicular divergence angle than those of conventional LEDs, lenses and the process for forming lenses becomes unnecessary. This lowers the costs and enables freer arrangement of the elliptically light distributing LEDs because there is no need to take into consideration the positions of the focal points of the lenses. Furthermore, the number of LEDs per tier can be increased without being restricted by the lens diameter.

To change the light-distribution characteristics of the elliptically light distributing LEDs 1, the shape of the resin lens that surrounds the LEDs 1 can be changed. For example, when widening the horizontal divergence angle from 70°, as shown in FIGS. 4(*b*) and 6(*b*), to 120°–150°, the lens that surrounds the LEDs 1 is made flatter than in the case in which the divergence angle is 70°.

As seen from the above, according to the present invention, the horizontal light distribution characteristics can be nearly concentric with only a few LEDs. As a result, it is possible to uniformly distribute light horizontally, and it is also possible to make the lighting fixture lighter and smaller.

Furthermore, according to the present invention, an ideal light-distribution condition can be obtained, and a horizontal light distribution can be more uniform.

In addition, a diffusion part can be easily formed on the inner surface of the lens by simply pasting a film on the inner surface of the lens, thereby providing a cost effective solution for such applications.

Also, in the present invention, several LEDs are arranged around the horizontal circumference inside the lens easily and accurately; and it is possible to easily make a lens unit in which the LEDs and the lenses are integrated.

In addition, according to the present invention, an LED lighting fixture including two or more tiers of unit-type lenses can be easily assembled by simply stacking two or more of these unit-type lenses. The number of tiers can be easily changed by increasing or L decreasing the number of unit-type lenses 2*a* to be stacked. Moreover, even if the number of tiers is changed, there is no need to prepare a special lens to accommodate the different height of the lighting fixture. Only the number of identical unit-type lenses needs to be changed.

Also, in the present invention, several unit-type lenses are easily stacked in two or more tiers.

Furthermore, in the present invention, lenses and the process for forming lenses are unnecessary. This results in lower costs and enables freer arrangement of the elliptically light distributing LEDs because there is no need to take into consideration the positions of the focal points of the lenses. In addition, the number of LEDs per tier can be increased without being restricted by the lens diameter.

What is claimed is:

1. An LED lighting fixture wherein a plurality of elliptically light distributing LEDs are arranged radially on a horizontal circumference and wherein each of said plurality of elliptically light distributing LEDs have a wider divergence angle horizontally than vertically.

2. The LED lighting fixture according to claim 1, further comprising a lens provided with a diffusion part that diffuses light only in a horizontal direction.

3. The LED lighting fixture according to claim 2, wherein the diffusion part is a film.

4. An LED lighting fixture wherein a lens is comprised of a cylindrical lens, and a plurality of elliptically light distributing LEDs are provided in a center of said cylindrical lens and arranged radially on a horizontal circumference and wherein each of said plurality of elliptically light distributing LEDs have a wider divergence angle horizontally than vertically.

5. The LED lighting fixture according to claim 4, wherein said lens is comprised of a plurality of said cylindrical lenses that are stacked one upon another.

6. The LED lighting fixture according to claim 5, wherein the stack of said plurality of cylindrical lenses are fastened together by a screw that extends axially of said cylindrical lenses and though bosses provided in a center of each of said plurality of cylindrical lenses.

7. An LED lighting fixture comprising a plurality of LEDs each having a horizontal divergence angle of 120°–150°, which is wider than that of a conventional LED, and a vertical divergence angle that is narrower than that of a conventional LED.

* * * * *